US010424262B2

(12) United States Patent
Igawa et al.

(10) Patent No.: US 10,424,262 B2
(45) Date of Patent: Sep. 24, 2019

(54) GATE DRIVING CIRCUIT AND DISPLAY DEVICE INCLUDING THE SAME

(71) Applicant: SAMSUNG DISPLAY CO., LTD., Yongin-si, Gyeonggi-do (KR)

(72) Inventors: Masami Igawa, Suwon-si (KR); Noboru Takeuchi, Asan-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 262 days.

(21) Appl. No.: 15/446,368

(22) Filed: Mar. 1, 2017

(65) Prior Publication Data

US 2017/0256225 A1 Sep. 7, 2017

(30) Foreign Application Priority Data

Mar. 3, 2016 (KR) ..... 10-2016-0025867

(51) Int. Cl.
*G09G 3/36* (2006.01)

(52) U.S. Cl.
CPC ..... *G09G 3/3677* (2013.01); *G09G 3/3688* (2013.01); *G09G 2300/0809* (2013.01); *G09G 2310/0248* (2013.01); *G09G 2310/0286* (2013.01); *G09G 2310/08* (2013.01)

(58) Field of Classification Search
CPC ..... G09G 3/3677; G09G 3/3688; G09G 2300/0809; G09G 2310/0248; G09G 2310/0286; G09G 2310/08
See application file for complete search history.

(56) References Cited

U.S. PATENT DOCUMENTS

| | | | | |
|---|---|---|---|---|
| 2014/0240209 | A1 | 8/2014 | Zhang | |
| 2015/0070255 | A1 | 3/2015 | Lin et al. | |
| 2015/0187433 | A1 | 7/2015 | Zheng et al. | |
| 2015/0194444 | A1* | 7/2015 | Koo | H01L 27/124 257/43 |
| 2016/0171950 | A1 | 6/2016 | Cho et al. | |

FOREIGN PATENT DOCUMENTS

| | | | |
|---|---|---|---|
| KR | 10-1110133 | B1 | 1/2012 |
| KR | 10-1250158 | B1 | 3/2013 |
| KR | 10-2015-0003054 | A | 1/2015 |
| KR | 10-1596613 | B1 | 2/2016 |
| KR | 10-2016-0072337 | A | 6/2016 |

* cited by examiner

*Primary Examiner* — Mark Edwards
(74) *Attorney, Agent, or Firm* — Lee & Morse, P.C.

(57) ABSTRACT

A gate driving circuit includes a plurality of stages. A k-th stage from among the plurality of stages, the k-th stage includes a first input circuit to receive a (k−1)th gate signal from a (k−1)th stage and to precharge a first node, a second input circuit to receive a (k+2)th gate signal from a (k+2)th stage to transmit the received (k+2)th gate signal to a second node, an output circuit to output a first clock signal as a k-th gate signal in response to a signal of the first node, a discharge circuit configured to discharge the first node through the k-th gate signal in response to a signal of the second node, a first transfer circuit to transfer a second clock signal to the first node, and a second transfer circuit to transfer the first clock signal to the second node.

20 Claims, 8 Drawing Sheets

GATE DRIVING CIRCUIT AND DISPLAY DEVICE INCLUDING THE SAME

CROSS-REFERENCE TO RELATED APPLICATION

Korean Patent Application No. 10-2016-0025867, filed on Mar. 3, 2016, in the Korean Intellectual Property Office, and entitled: "Gate Driving Circuit and Display Device Including the Same," is incorporated by reference herein in its entirety.

BACKGROUND

1. Field

The present disclosure herein relates to a gate driving circuit and a display device including the same.

2. Description of the Related Art

A display device includes a plurality of gate lines, a plurality of data lines, and a plurality of pixels connected to the plurality of gate lines and the plurality of data lines. The display device includes a gate driving circuit for sequentially providing gate signals to the plurality of gate lines and a data driving circuit for outputting data signals to the plurality of data lines.

The gate driving circuit includes a shift register with a plurality of driving circuits (hereinafter referred to as driving stages). The plurality of driving stages respectively output gate signals corresponding to the plurality of gate lines. Each of the plurality of driving stages includes a plurality of connected transistors.

SUMMARY

An embodiment provides a gate driving circuit including a plurality of stages, wherein a k-th stage (k is a positive integer) among the plurality of stages includes a first input circuit to receive a (k−1)th gate signal from a (k−1)th stage and to precharge a first node, a second input circuit to receive a (k+2)th gate signal from a (k+2)th stage to transmit the received (k+2)th gate signal to a second node; an output circuit to output a first clock signal as a k-th gate signal in response to a signal of the first node, a discharge circuit to discharge the first node through the k-th gate signal in response to a signal of the second node; a first transfer circuit to transfer a second clock signal to the first node, and a second transfer circuit to transfer the first clock signal to the second node.

In an embodiment, the output circuit may include an output transistor including a first electrode connected to the first clock signal, a second electrode to output the k-th gate signal, and a gate electrode connected to the first node.

In an embodiment, the first transfer circuit may include a first transfer transistor including a first electrode connected to the second clock signal, a second electrode connected to the first node, and a gate electrode connected to the second clock signal.

In an embodiment, the first transfer circuit may further include a first transfer capacitor connected between the first node and the second electrode of the first output transistor.

In an embodiment, the second transfer circuit may include a second transfer capacitor connected between the first clock signal and the second node.

In an embodiment, the second transfer circuit may further include a second transfer transistor including a first node connected to the second node, a second electrode connected to the (k+2)th gate signal from the (k+2)th stage, and a gate electrode connected to the second node.

In an embodiment, the first input circuit may include a first input transistor including a first electrode connected to the (k−1)th gate signal from the (k−1)th stage, a second electrode connected to the first node, and a gate electrode connected to the (k−1)th gate signal.

In an embodiment, the second input circuit may include a second input transistor including a first electrode connected to the (k+2)th gate signal from the (k+2)th stage, a second electrode connected to the second node, and a gate electrode connected to the (k+2)th gate signal.

In an embodiment, when the second clock signal shifts from a low level to a high level, the first transfer circuit may transfer the second clock signal to the first node at an increasing speed proportional to a first time constant.

In an embodiment, the second transfer circuit may transfer the first clock signal to the second node and discharge a signal of the second node as a signal level of the second input terminal at a speed proportional to a second time constant.

In an embodiment, a display device includes a display panel including a plurality of pixels respectively connected to a plurality of gate lines and a plurality of data lines, a gate driving circuit including a plurality of stages to output gate signals to the plurality of gate lines; and a data driving circuit to drive the plurality of data lines. A a k-th stage (k is a positive integer) among the plurality of stages includes a first input circuit to receive a (k−1)th gate signal from a (k−1)th stage and to precharge a first node, a second input circuit to receive a (k+2)th gate signal from a (k+2)th stage to transmit the received (k+2)th gate signal to a second node, an output circuit to output a first clock signal as a k-th gate signal in response to a signal of the first node, a discharge circuit to discharge the first node through the k-th gate signal in response to a signal of the second node; a first transfer circuit to transfer a second clock signal to the first node, and a second transfer circuit to transfer the first clock signal to the second node.

In an embodiment, the output circuit may include an output transistor including a first electrode connected to the first clock signal, a second electrode to output the k-th gate signal, and a gate electrode connected to the first node.

In an embodiment, the first transfer circuit may include a first transfer transistor including a first electrode connected to the second clock signal, a second electrode connected to the first node, and a gate electrode connected to the second clock signal, and a first transfer capacitor connected between the first node and the second electrode of the first output transistor.

In an embodiment, the second transfer circuit may include a second transfer capacitor connected between the first clock signal and the second node, a second transfer transistor including a first node connected to the second node, a second electrode connected to the (k+2)th gate signal from the (k+2)th stage, and a gate electrode connected to the second node.

In an embodiment, the first input circuit may include a first input transistor including a first electrode connected to the (k−1)th gate signal from the (k−1)th stage, a second electrode connected to the first node, and a gate electrode connected to the (k−1)th gate signal.

In an embodiment, the second input circuit may include a second input transistor including a first electrode connected to the (k+2)th gate signal from the (k+2)th stage, a second electrode connected to the second node, and a gate electrode connected to the (k+2)th gate signal.

In an embodiment, when the second clock signal shifts from a low level to a high level, the first transfer circuit may transfer the second clock signal to the first node at an increasing speed proportional to a first time constant.

In an embodiment, the second transfer circuit may transfer the first clock signal to the second node and discharge a signal of the second node as a signal level of the second input terminal at a speed proportional to a second time constant.

In an embodiment, the display panel may include a display area where the plurality of pixels are arranged and a non display area adjacent to the display area, wherein the gate driving circuit may be integrated into the non display area.

In an embodiment, the display device may further include a driving controller configured to control the gate driving circuit and the data driving circuit in response to a control signal and an image signal provided from the outside, and provide the first clock signal and the second clock signal to each of the plurality of stages.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
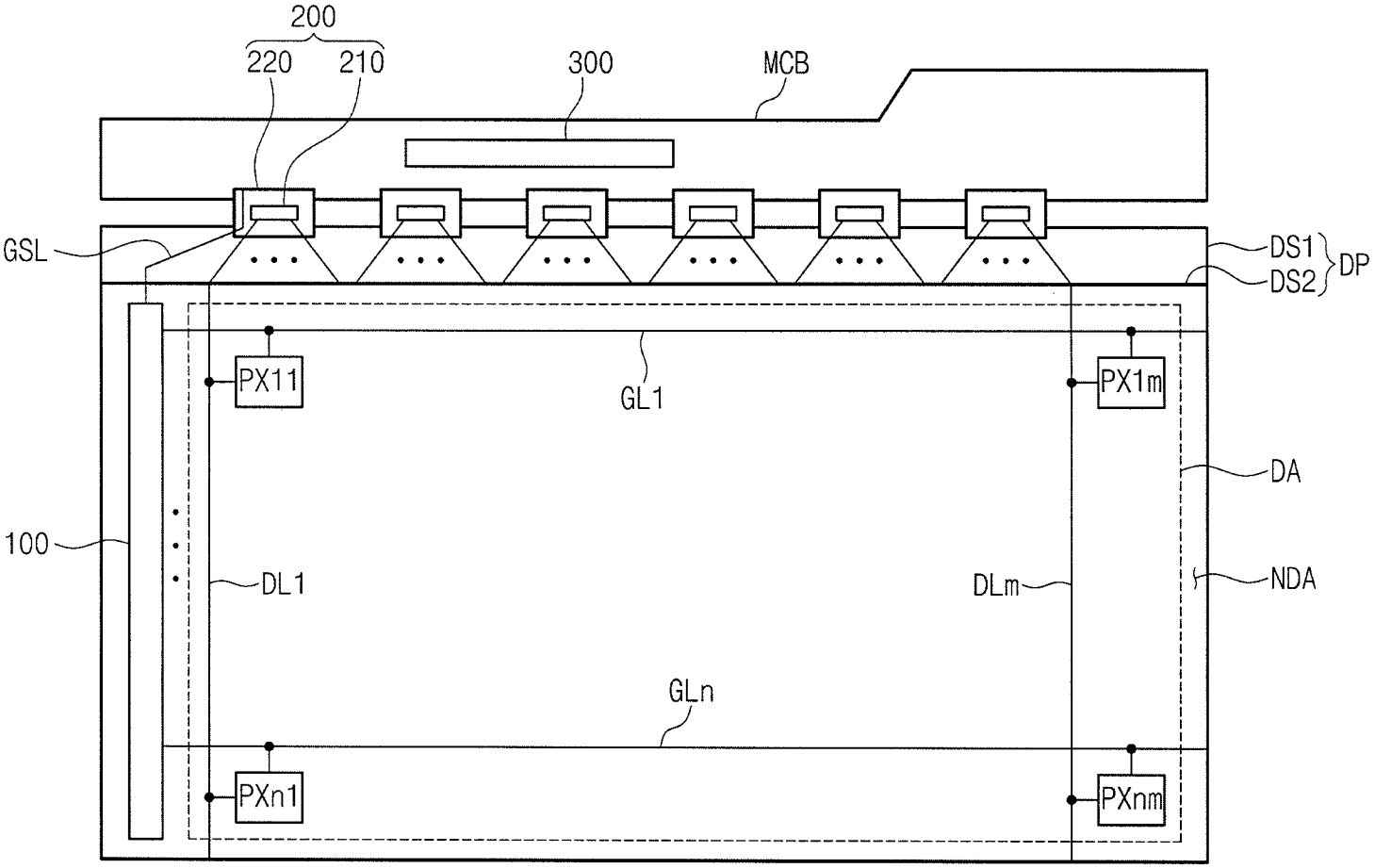
FIG. 1 illustrates a plan view of a display device according to an embodiment.
Figure 2:
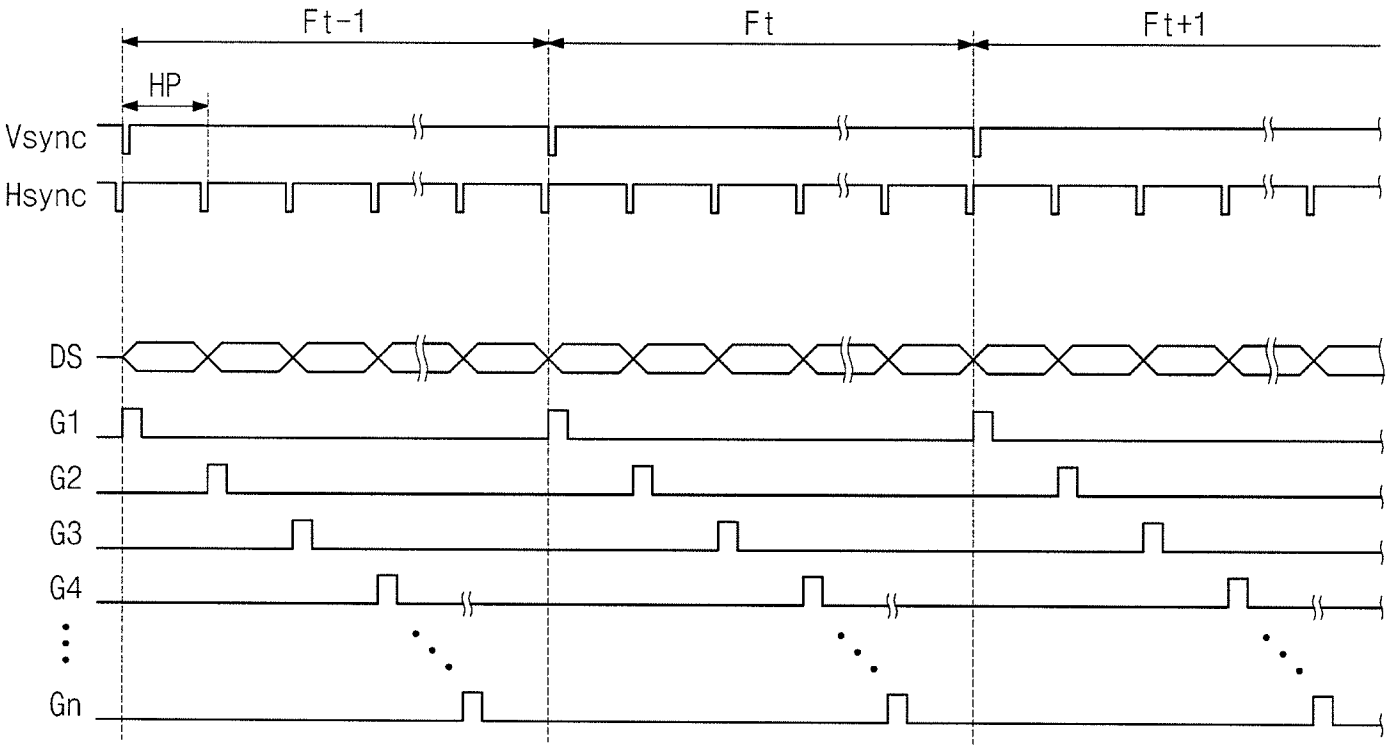
FIG. 2 illustrates a timing diagram of signals of a display device according to an embodiment.

FIG. 1 is a plan view of a display device according to an embodiment. FIG. 2 is a timing diagram illustrating signals of a display device according to an embodiment. As shown in FIGS. 1 and 2, a display device according to an embodiment includes a display panel DP, a gate driving circuit 100, a data driving circuit 200, and a driving controller 300.

The display panel DP is not particularly limited thereto and may include various display panels, e.g., a liquid crystal display panel, an organic light emitting display panel, an electrophoretic display panel, an electrowetting display panel, and so forth. In this embodiment, the display panel DP is described as a liquid crystal display panel. A liquid crystal display device including a liquid crystal display panel may further include a polarizer and a backlight circuit.

The display panel DP includes a first substrate DS1, a second substrate DS2 spaced apart from the first substrate DS1, and a liquid crystal layer LCL disposed between the first substrate DS1 and the second substrate DS2. On a plane, the display panel DP includes a display area DA where a plurality of pixels PX11 to PXnm and a non display area NDA surrounding the display area DA.

The display panel DP includes a plurality of gate lines GL1 to GLn disposed on the first substrate DS1 and a plurality of data lines DL1 to DLm intersecting the plurality of gate lines GL1 to GLn. The plurality of gate lines GL1 to GLn are connected to the gate driving circuit 100. The plurality of data lines DL1 to DLm are connected to the data driving circuit 200. Only some of the plurality of gate lines GL1 to GLn and only some of the plurality of data lines DL1 to DLm are illustrated in FIG. 1.

Only some of the plurality of pixels PX11 to PXnm are illustrated in FIG. 1. The plurality of pixels PX11 to PXnm are respectively connected to corresponding gate lines among the plurality of gate lines GL1 to GLn and corresponding data lines among the plurality of data lines DL1 to DLm.

The plurality of pixels PX11 to PXnm may be divided into a plurality of groups according to a color displayed. The plurality of pixels PX11 to PXnm may display one of primary colors. The primary colors may include red, green, blue, and white. However, embodiments are not limited thereto, e.g., the primary colors may include various colors such as yellow, cyan, magenta, and so on.

The gate driving circuit 100 and the data driving circuit 200 receive a control signal from the driving controller 300. The driving controller 300 may be mounted on a main circuit board MCB. The driving controller 300 receives image data and control signals from an external graphic control circuit. The control signals may include vertical sync signals Vsync that are signals for distinguishing frame sections Ft−1, Ft, and Ft+1, horizontal sync signals Hsync that are signals for distinguishing horizontal sections HP, e.g., row distinction signals, and data enable signals, e.g., at high level only when data is output to be displayed, and clock signals.

The gate driving circuit 100 generates gate signals G1 to Gn on the basis of a control signal (hereinafter referred to as a gate control signal) received from the driving controller 300 through a signal line GSL and outputs the gate signals G1 to Gn to the plurality of gate lines GL1 to GLn, during the frame sections Ft−1, Ft, and Ft+1. The gate signals G1 to Gn may be sequentially output in correspondence to the horizontal sections HP. The gate driving circuit 100 and the pixels PX11 to PXnm may be formed simultaneously through a thin film process. For example, the gate driving circuit 100 may be mounted in an oxide semiconductor TFT gate driver circuit form in the non display area NDA.

FIG. 1 illustrates one gate driving circuit 100 connected to a first end, e.g., left ends, of the plurality of gate lines GL1 to GLn. According to an embodiment, a display device may include two gate driving circuits. One of the two gate driving circuits may be connected to the first ends of the plurality of gate lines GL1 to GLn and the other one may be connected to second ends, e.g., the right ends, of the plurality of gate lines GL1 to GLn. Additionally, one of the two gate driving circuits may be connected to odd gate lines and the other one may be connected to even gate lines.

The data driving circuit 200 generates grayscale voltages according to image data provided from the driving controller 300 on the basis of a control signal (hereinafter referred to as a data control signal) received from the driving controller 300. The data driving circuit 200 outputs the grayscale voltages as data voltages DS to the plurality of data lines DL1 to DLm.

The data voltages DS may include positive data voltages having a positive value with respect to a common voltage and/or negative data voltages having a negative value with respect to the common voltage. Some of data voltages applied to the data lines DL1 to DLm have a positive polarity and others have a negative polarity during each of the horizontal sections HP. The polarity of the data voltages DS may be inverted according to the frame sections Ft−1, Ft, and Ft+1 in order to prevent the deterioration of a liquid crystal. The data driving circuit 200 may generate data voltages inverted by each frame section circuit in response to an invert signal.

The data driving circuit 200 may include a driving chip 210 and a flexible circuit board 220 mounting the driving chip 210. The data driving circuit 200 may include a plurality of driving chips 210 and the flexible circuit board 220. The flexible circuit board 220 connects the main circuit board MCB and the first substrate DS1 electrically. The plurality of driving chips 210 provide data signals corresponding to corresponding data lines among the plurality of data lines DL1 to DLm.

FIG. 1 illustrates a Tape Carrier Package (TCP) type data driving circuit 200 exemplarily. According to another embodiment, the data driving circuit 200 may be disposed on the non display area NDA of the first substrate DS1 through a Chip on Glass (COG) method.

Figure 3:
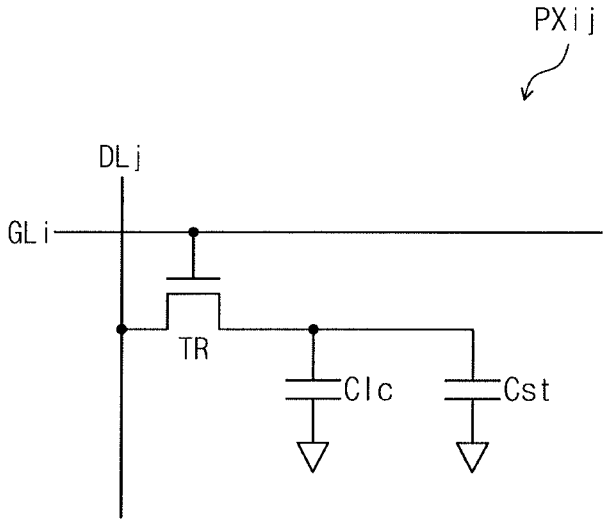
FIG. 3 illustrates an equivalent circuit diagram of a pixel according to an embodiment.
Figure 4:
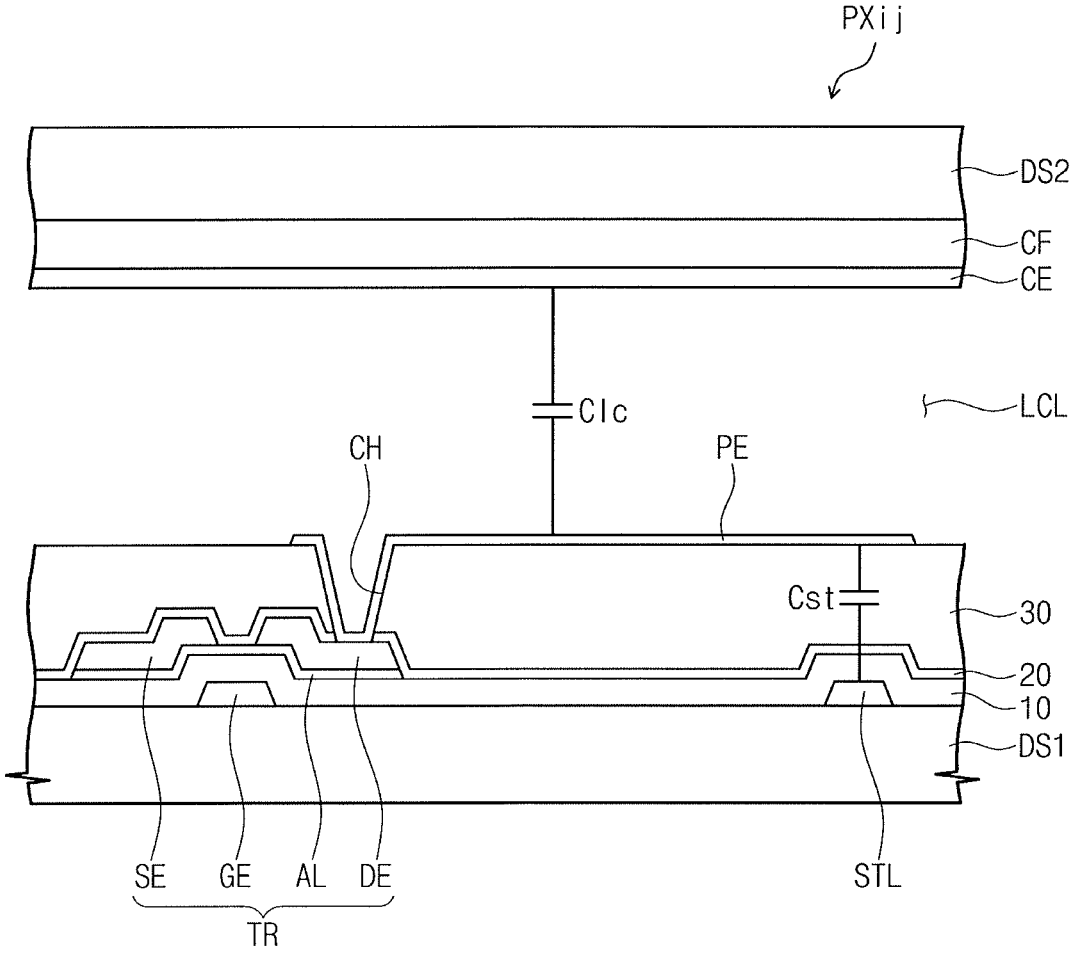
FIG. 4 is a sectional view of a pixel according to an embodiment.

FIG. 3 is an equivalent circuit diagram of a pixel according to an embodiment. FIG. 4 is a sectional view of a pixel according to an embodiment. Each of the plurality of pixels PX11 to PXnm shown in FIG. 1 may have an equivalent circuit shown in FIG. 3.

As shown in FIG. 3, the PXij includes a pixel thin film transistor (hereinafter referred to as a pixel transistor) TR, a liquid crystal capacitor Clc, and a storage capacitor Cst. Hereinafter, in the specification, a transistor refers to a thin film transistor. According to an embodiment, the storage capacitor Cst may be omitted.

The pixel transistor TR is electrically connected to an ith gate line GLi and a jth data line DLj. The pixel transistor TR outputs a pixel voltage corresponding to a data signal received from the jth data line DLj in response to a gate signal received from the ith gate line GLi.

The liquid crystal capacitor Clc is charged with a pixel voltage output from the pixel transistor TR. An arrangement of liquid crystal directors included in a liquid crystal layer LCL (see FIG. 4) is changed according to a charge amount charged in the liquid crystal capacitor CLC. The light incident to a liquid crystal layer may be transmitted or blocked according to an arrangement of liquid crystal directors.

The storage capacitor Cst is connected in parallel to the liquid crystal capacitor Clc. The storage capacitor Cst maintains an arrangement of liquid crystal directors during a predetermined section.

As shown in FIG. 4, the pixel transistor TR includes a control electrode GE connected to the ith gate line GLi (see FIG. 3), an activation part AL overlapping the control electrode GE, a first electrode SE connected to the jth data line DLj (see FIG. 3), and a second electrode DE disposed spaced apart from the first electrode SE.

The liquid crystal capacitor Clc includes a pixel electrode PE and a common electrode CE. The storage capacitor Cst includes the pixel electrode PE and a portion of a storage line STL overlapping the pixel electrode PE.

The ith gate line GLi and the storage line STL may be on a first surface of the first substrate DS1, e.g., a surface facing the second substrate DS2. The control electrode GE is branched from the ith gate line GLi. The ith gate line GLi and the storage line STL may include a metal (for example, aluminum (Al), silver (Ag), copper (Cu), molybdenum (Mo), chromium (Cr), tantalum (Ta), titanium (Ti), and so forth) or an alloy thereof. The ith gate line GLi and the storage line STL may have a multi layer structure, and may include, e.g., a Ti layer and a Cu layer.

A first insulating layer 10 covering the control electrode GE and the storage line STL may be on a first surface of the first substrate DS1, e.g., a surface facing the second substrate DS2. The first insulating layer 10 may include at least one of an inorganic material and an organic material. The first insulating layer 10 may be an organic layer or an inorganic layer. The first insulating layer 10 may have a multi layer structure and may include, e.g., a silicon nitride layer and a silicon oxide layer.

The activation part AL overlapping the control electrode GE is disposed on the first insulating layer 10. The activation part AL may include a semiconductor layer and an ohmic contact layer. The semiconductor layer is disposed on the first insulating layer 10 and the ohmic contact layer is disposed on the semiconductor layer.

The second electrode DE and the first electrode SE are disposed on the activation part AL. The second electrode DE and the first electrode SE are disposed spaced apart from each other. Each of the second electrode DE and the first electrode SE overlaps the control electrode GE partially.

A second insulating layer 20 covering the activation part AL, the second electrode DE, and the first electrode SE is disposed on the first insulating layer 10. The second insulating layer 20 may include at least one of an inorganic material and an organic material. The second insulating layer 20 may be an organic layer or an inorganic layer. The second insulating layer 20 may have a multi layer structure and for example, may include, e.g., a silicon nitride layer and a silicon oxide layer.

Although the pixel transistor TR having a staggered structure is shown in FIG. 1 exemplarily, a structure of the pixel transistor TR is not limited thereto. For example, the pixel transistor TR may have a planar structure.

A third insulation layer 30 is disposed on the second insulation layer 20. The third insulating layer 30 may provide a flat upper surface. The third insulating layer 30 may include an organic material.

The pixel electrode PE may be on the third insulating layer 30. The pixel electrode PE is connected to the second electrode DE through a contact hole CH penetrating the second insulating layer 20 and the third insulating layer 30. An alignment layer covering the pixel electrode PE may be disposed on the third insulating layer 30.

A color filter layer CF is disposed a first surface of the second substrate DS2, e.g., a surface facing the first substrate DS1. A common electrode CE is disposed on the color filter layer CF. A common voltage may be supplied to the common electrode CE. A common voltage and a pixel voltage have different values. An alignment layer covering the common electrode CE may be disposed on the common electrode CE. Another insulating layer may be disposed between the color filter layer CF and the common electrode CE.

The pixel electrode PE and the common electrode CE with the liquid crystal layer LCL therebetween form the liquid crystal capacitor Clc. Additionally, portions of the pixel electrode PE and the storage line STL, which are disposed with the first insulating layer 10, the second insulating layer 20, and the third insulating layer 30 therebetween, form the storage capacitor Cst. The storage line STL receives a storage voltage having a different value than a pixel voltage. A storage voltage may have the same value as a common voltage.

On the other hand, a section of the pixel PXij shown in FIG. 3 is just one example. For example, at least one of the color filter layer CF and the common electrode CE may be disposed on the first substrate DS1. That is, a liquid display panel according to this embodiment may include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 5:
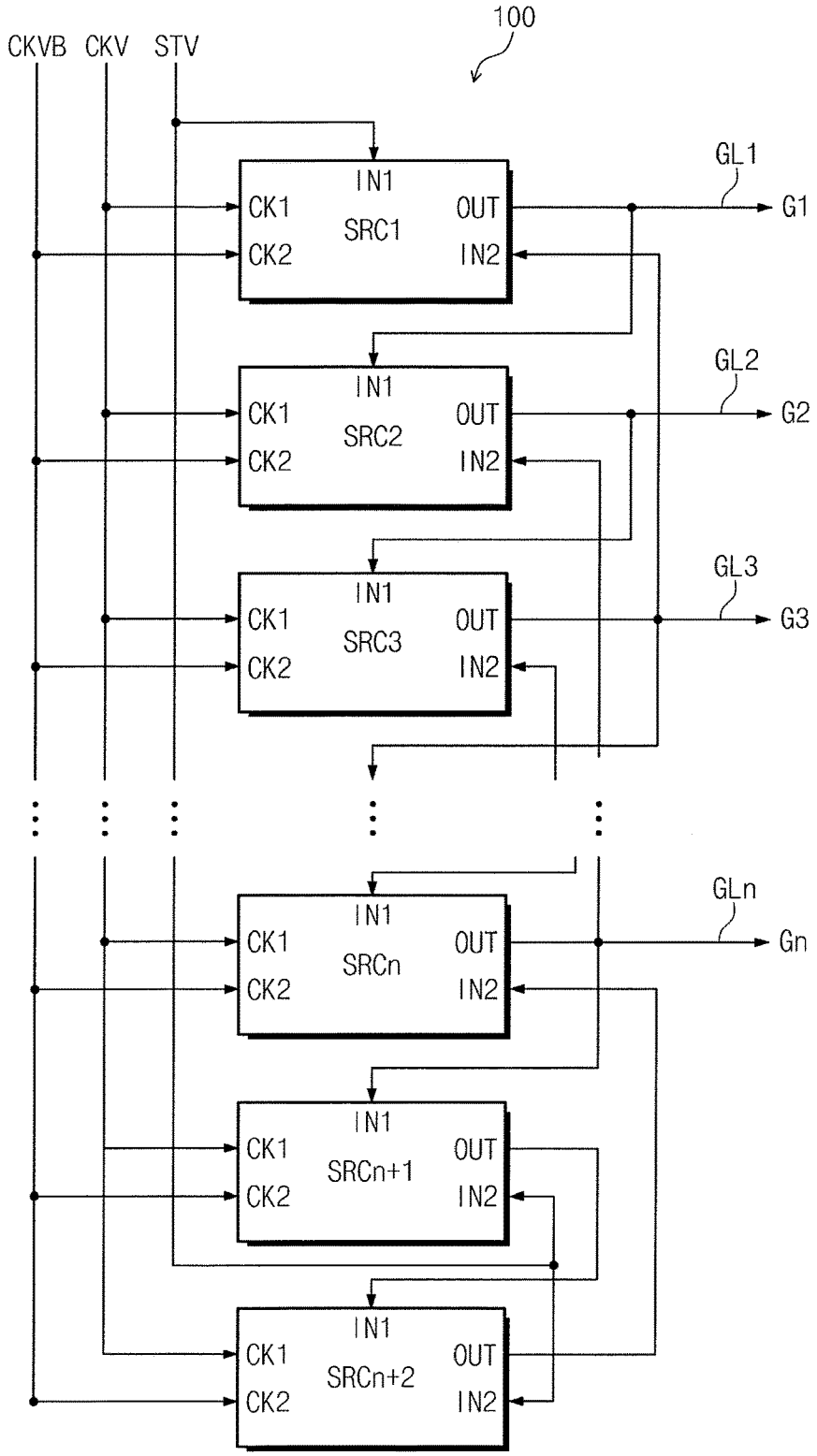
FIG. 5 illustrates a block diagram of a gate driving circuit according to an embodiment.

FIG. 5 is a block diagram illustrating the gate driving circuit 100 according to an embodiment. As shown in FIG. 5, the gate driving circuit 100 includes a plurality of driving stages SRC1 to SRCn and dummy driving stages SRCn+1 and SRCn+2. The plurality of driving stages SRC1 to SRCn and dummy driving stages SRCn+1 and SRCn+2 have a cascade relationship in which they operate in response to a carry signal output from a previous stage and a carry signal output from the next stage.

Each of the plurality of driving stages SRC1 to SRCn receives a first clock signal CKV or a second clock signal CKVB from the driving controller 300 shown in FIG. 1. The driving stage SRC1 and the dummy driving stages SRCn+1 and SRCn+2 further receive a start signal STV from the driving controller 300.

According to this embodiment, the plurality of driving stages SRC1 to SRCn are respectively connected to the plurality of gate lines GL1 to GLn. The plurality of driving stages SRC1 to SRCn respectively provide gate signals to the plurality of gate lines GL1 to GLn. According to an embodiment, gate lines connected to the plurality of driving stages SRC1 to SRCn may be odd gate lines or even gate lines among the entire gate lines.

Each of the plurality of driving stages SRC1 to SRCn and the dummy driving stage SRCn+1 and SRCn+2 includes a first input terminal IN1, a second input terminal IN2, a first clock terminal CK1, a second clock terminal CK2, and an output terminal OUT.

The output terminal OUT of each of the plurality of driving stages SRC1 to SRCn is connected to a corresponding gate line among the plurality of gate lines GL1 to GLn. Gate signals generated from the plurality of driving stages SRC1 to SRCn are provided to the plurality of gate lines GL1 to GLn through the output terminal OUT.

The first clock terminal CK1 of each of the plurality of driving stages SRC1 to SRCn receives the first clock signal CKV and the second clock terminal CK2 thereof receives the second clock signal CKVB. The first clock signal CKV and the second clock signal CKVB may have different phases.

The input terminal IN1 of each of the plurality of driving stages SRC2 to SRCn and dummy driving stages SRCn+1 and SRCn+2 receives a gate signal from a previous driving stage of a corresponding driving stage. For example, the first input terminal IN1 of the third driving stage SRC3 receives a gate signal of the second driving stage SRC2. The first input terminal IN1 of the first driving stage SRC1 among the plurality of driving stages SRC1 to SRCn receives a start signal STV for starting the drive of the gate driving circuit 100 instead of the gate signal of a previous driving stage.

The second input terminal IN2 of each of the plurality of driving stages SRC1 to SRCn receives a gate signal of the next-next driving stage of a corresponding driving stage. For example, the second input terminal IN1 of the first driving stage SRC1 receives a gate signal of the third driving stage SRC3 and the second input terminal IN1 of the second driving stage SRC2 receives a gate signal of the fourth driving stage SRC4. The second input terminal IN2 of the dummy driving stages SRCn+1 and SRCn+2 receives a start signal STV for starting the drive of the gate driving circuit 100.

Alternatively, each of the plurality of driving stages SRC1 to SRCn and dummy driving stages SRCn+1 to SRCn+2 may omit one of the output terminal OUT, the first input terminal IN1, the second input terminal IN2, the first clock terminal CK1, and the second clock terminal CK2, and/or may further include other terminals.

Figure 6:
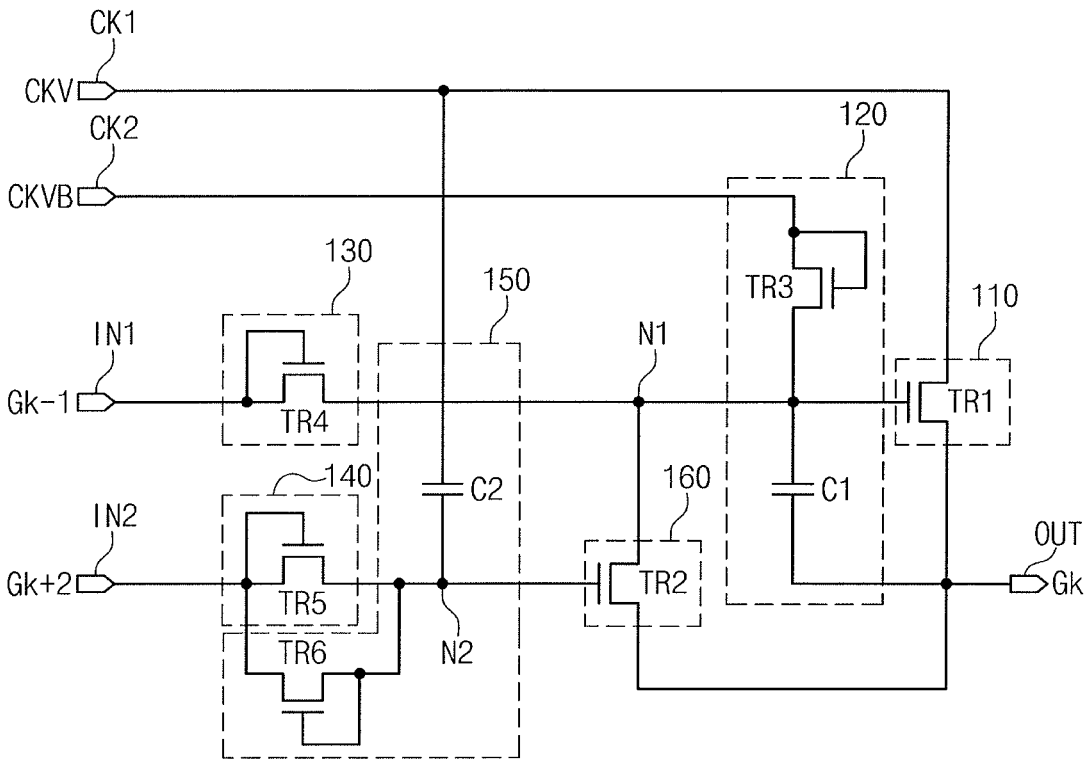
FIG. 6 illustrates a circuit diagram of a driving stage according to an embodiment.

FIG. 6 is a circuit diagram of a driving stage according to an embodiment. FIG. 6 illustrates the k-th driving stage SRCk (k is a positive integer) among the plurality of driving stages SRC1 to SRCn shown in FIG. 5. Each of the plurality of driving stages SRC1 to SRCn shown in FIG. 5 may have the same circuit as the k-th driving stage SRCk.

Referring to FIG. 6, the k-th driving stage SRCk includes an output circuit 110, a first transfer circuit 120, a first input circuit 130, a second input circuit 140, a second transfer circuit 150, and a discharge circuit 160.

The output circuit 110 outputs the first clock signal CKV received through the first clock terminal CK1 as the k-th gate signal Gk in response to a signal of a first node N1. The first input circuit 130 receives a (k−1)th gate signal Gk−1 from a (k−1)th stage SRCk−1 and pre-charges the first node N1. The second input circuit 140 receives a (k+2)th gate signal Gk+2 from a (k+2)th stage SRCk+2 and transmits it to a second node N2.

The first transfer circuit 120 transmits the second clock signal CKBV received through the second clock terminal CK2 to the first node N1. The second transfer circuit 150 transmits the first clock signal CKV received through the first clock terminal CK1 to the second node N2. The discharge circuit 160 discharges the first node N1 through the k-th gate signal Gk in response to a signal of the second node N2.

A specific configuration example of the output circuit 110, the first transfer circuit 120, the first input circuit 130, the second input circuit 140, the second transfer circuit 150, and the discharge circuit 160 is described below.

The output circuit 110 includes an output transistor TR1. The output transistor TR1 includes a first electrode connected to the first clock terminal CK1, a second electrode connected to the output terminal OUT, and a gate electrode connected to the first node N1.

The first transfer circuit 120 includes a first transfer transistor TR3 and a first capacitor C1. The first transfer transistor TR3 includes a first electrode connected to the second clock terminal CK2, a second electrode connected to the first node N1, and a gate electrode connected to the second clock terminal CK2. The first capacitor C1 is connected between the first node N1 and the output terminal OUT.

The first input circuit 130 includes a first input transistor TR4. The first input transistor TR4 includes a first electrode connected to the first input terminal IN1, a second electrode connected to the first node N1, and a gate electrode connected to the first input terminal IN1.

The second input circuit 140 includes a second input transistor TR5. The second input transistor TR5 includes a first electrode connected to the second input terminal IN2, a second electrode connected to the second node N2, and a gate electrode connected to the second input terminal IN2.

The second transfer circuit 150 includes a second capacitor C2 and a second transfer transistor TR6. The second capacitor C2 is connected between the second clock terminal CK2 and the second node N2. The second transfer transistor TR6 includes a first electrode connected to the second node N2, a second electrode connected to the second input terminal IN2, and a gate electrode connected to the second node N2.

The discharge circuit 160 includes a discharge transistor TR2. The discharge transistor TR2 includes a first electrode connected to the first node N1, a second electrode connected to the output terminal OUT, and a gate electrode connected to the second node N2.

Figure 7:
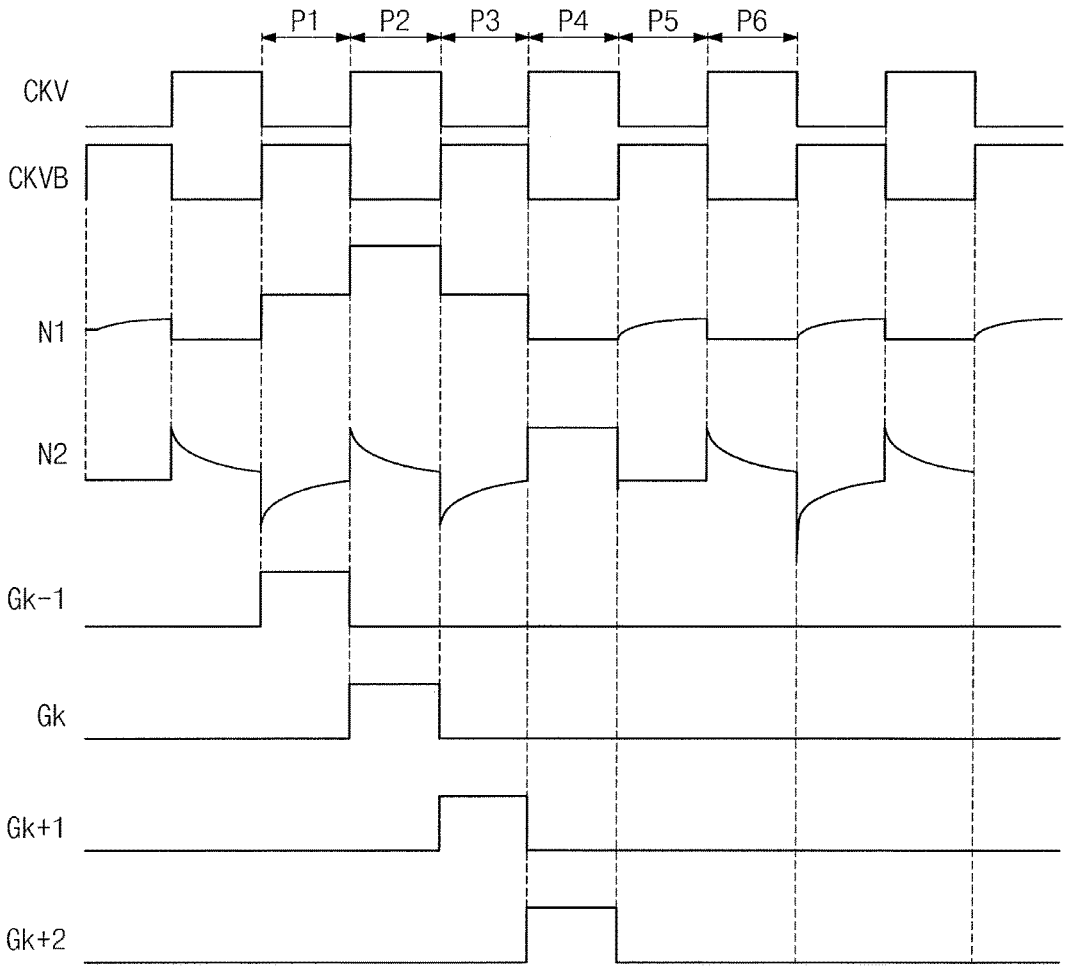
FIG. 7 illustrates a timing diagram of an operation of a driving stage shown in FIG. 6.

FIG. 7 is a timing diagram illustrating an operation of a driving stage shown in FIG. 6. Referring to FIGS. 6 and 7, the first clock signal CKV provided to the first clock terminal CK1 and the second clock signal CKVB provided to the second clock terminal CK2 are complementary signals having phases opposite to each other.

During a first section P1, the first clock signal CKV is in a low level; the second clock signal CKVB is in a high level; and a (k−1)th gate signal Gk−1 is in a high level. When the first input transistor TR4 is turned on by the (k−1)th gate signal Gk−1, the first node N1 is precharged. At this point, since the first clock signal CKV is low level, the output transistor TR1 maintains a turn off state.

When the first clock signal CKV shifts to a high level in a second section P2, as the output transistor TR1 is turned on, a signal level of the first node N1 is boosted-up by the first capacitor C1 and the k-th gate signal Gk output to the output terminal OUT shifts to a high level. At this point, even if a voltage of the second node N2 rises temporarily by the first clock signal CKV of a high level, since the output terminal OUT connected to the second node of the discharge transistor TR2 is high level, the discharge transistor TR2 may maintain a turn off state.

In a third section P3, when the second clock signal CKVB shifts to a high level, the first transfer transistor T3 is turned on so that the first node N1 is maintained at a high level. Since the first node N1 is high level, the output transistor TR1 maintains a turn on state. Since the first clock signal CKV shifts to a low level, the k-th gate signal Gk of the output terminal OUT is discharged as the first clock signal CKV of a low level.

In a fourth section P4, when the first clock signal CKV shifts to a high level, since the (k+2)th gate signal Gk+2 shifts to a high level, the second node N2 rises to a high level so that the discharge transistor TR2 is turned on. When the discharge transistor TR2 is turned on, a signal of the first node N1 is discharged to the output terminal OUT of a low level. When the first node N1 shifts to a low level, the output transistor TR1 is turned off.

In a fifth section P5, when the second clock signal CKVB shifts to a high level, the second clock signal CKVB is transmitted to the first node N1 at an increasing speed proportional to a first time constant by the first transfer transistor TR3 and the first capacitor C1. When a signal level of the first node N1 rises sufficiently, the output transistor TR1 is turned on. At this point, since the first clock signal CKV is at a low level, the k-th gate signal Gk of the output terminal OUT is discharged.

In a sixth section P6, when the first clock signal CKV shifts to a high level, the first clock signal CKV is transmitted to the second node N2 through the second capacitor C2, a signal of the second node N2 is discharged to the second input terminal IN2 of a low level at a speed proportional to a second time constant by the second capacitor C2 and the second transfer transistor TR3. While the second node N2 is high level, the discharge transistor TR2 is turned on so that the first node N1 is discharged to the output terminal OUT of a low level.

After the k-th gate signal Gk shifts from a high level to a low level in the frame section Ft shown in FIG. 2, until the k-th gate signal Gk shifts to a high level again in the next frame section Ft+1, as the fifth section P5 and the sixth section P6 shown in FIG. 7 are repeated, the k-th gate signal Gk may be maintained at a low level.

The first transfer transistor TR3 and the first capacitor C1 of the first transfer circuit 120 shown in FIG. 6 operate as a low pass filter having the first time constant. Therefore, a time that the output transistor TR1 is turned on by a signal of the first node N1 in the fifth section P5 may be less than half (50%) of the fifth section P5.

The second capacitor C2 and the second transfer transistor TR6 of the second transfer circuit 150 operate as a high pass filter having the second time constant. Therefore, a time that the discharge transistor TR2 is turned on by a signal of the second node N2 in the sixth section P6 may be less than half (50%) of the sixth section P6.

When a high voltage is provided to a gate electrode of transistor for a long time, a deterioration phenomenon that the threshold voltage of the transistor shifts may occur. According to an embodiment, by setting the turn on times of the output transistor TR1 and the discharge transistor TR2 to less than 50% during the fifth section P5 and the sixth section P6 occupying most of the frame section Ft, a deterioration phenomenon of the output transistor TR1 and the discharge transistor TR2 can be minimized.

According to another embodiment, if a capacitance between a gate electrode and a second electrode (for example, a source electrode) of the output transistor TR1 is sufficiently large, the first transfer circuit 120 may not include the first capacitor C1. Additionally, the second transfer transistor TR6 in the second transfer circuit 150 operates as a resistor connected between the second node N2 and the second input terminal IN2. Therefore, a resistor formed of a wire layer or a semiconductor layer may replace a second transfer transistor TR6. In the same manner, the second input circuit 140 may include a resistor connected between the second input terminal IN2 and the second node N2 instead of the second input transistor TR5.

Figure 8:
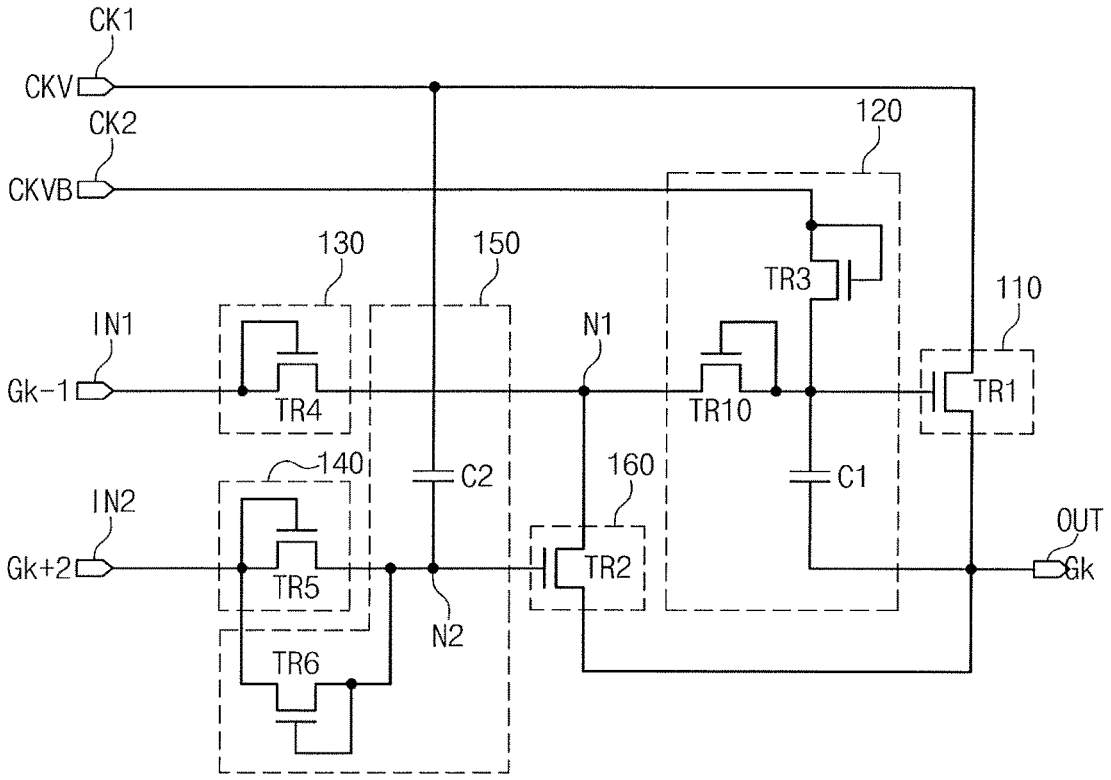
FIG. 8 illustrates a circuit diagram of a driving stage according to another embodiment.

FIG. 8 illustrates a circuit diagram of a driving stage according to another embodiment.

Referring to FIG. 8, an additional transistor TR10 connected between the third transistor TR3 and the first node N1 may be further included in order to alleviate a stress by the second clock signal CKVB applied to a gate electrode of the third transistor TR3 in the fifth section P5 shown in FIG. 7. In this case, the additional transistor TR10 may include a first electrode connected to the second electrode of the third transistor TR3, a second electrode connected to the first node N1, and a gate electrode connected to the second electrode of the third transistor TR3.

Since a gate driving circuit having such a configuration reduces a duty ratio of a signal provided to the gate electrodes of an output transistor and a discharge transistor, a deterioration phenomenon due to a gate voltage stress may be minimized. Thus, a driving circuit and a display device including the same may have improved reliability.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A gate driving circuit, comprising:

a plurality of stages to provide gate signals to gate lines of a display panel, wherein a k-th stage, where k is a natural number greater than or equal to 2, from among the plurality of stages includes;

a first input circuit to receive a (k−1)th gate signal from a (k−1)th stage and to precharge a first node;

a second input circuit to receive a (k+2)th gate signal from a (k+2)th stage to transmit the received (k+2)th gate signal to a second node;

an output circuit to output a first clock signal as a k-th gate signal in response to a signal of the first node;

a discharge circuit to discharge the first node through a connection to an output line of the output circuit that outputs the k-th gate signal in response to a signal of the second node;

a first transfer circuit to transfer a second clock signal to the first node; and a second transfer circuit to transfer the first clock signal to the second node.

2. The gate driving circuit as claimed in claim 1, wherein the output circuit includes an output transistor having a first electrode connected to the first clock signal, a second electrode to output the k-th gate signal, and a gate electrode connected to the first node.

3. The gate driving circuit as claimed in claim 2, wherein the first transfer circuit includes a first transfer transistor having a first electrode connected to the second clock signal, a second electrode connected to the first node, and a gate electrode connected to the second clock signal.

4. The gate driving circuit as claimed in claim 3, wherein the first transfer circuit further includes a first transfer capacitor connected between the first node and the second electrode of the first output transistor.

5. The gate driving circuit as claimed in claim 1, wherein the second transfer circuit includes a second transfer capacitor connected between the first clock signal and the second node.

6. The gate driving circuit as claimed in claim 5, wherein the second transfer circuit further includes:

a second transfer transistor having a first node connected to the second node, a second electrode connected to the (k+2)th gate signal from the (k+2)th stage, and a gate electrode connected to the second node.

7. The gate driving circuit as claimed in claim 1, wherein the first input circuit includes:

a first input transistor having a first electrode connected to the (k−1)th gate signal from the (k−1)th stage, a second electrode connected to the first node, and a gate electrode connected to the (k−1)th gate signal.

8. The gate driving circuit as claimed in claim 1, wherein the second input circuit includes:

a second input transistor having a first electrode connected to the (k+2)th gate signal from the (k+2)th stage, a second electrode connected to the second node, and a gate electrode connected to the (k+2)th gate signal.

9. The gate driving circuit as claimed in claim 1, wherein, when the second clock signal shifts from a low level to a high level, the first transfer circuit transfers the second clock signal to the first node at a speed proportional to a first time constant.

10. The gate driving circuit as claimed in claim 1, wherein the second transfer circuit transfers the first clock signal to the second node and discharges a signal of the second node as a signal level of the second input terminal at a speed proportional to a second time constant.

11. A display device, comprising:

a display panel including a plurality of pixels respectively connected to a plurality of gate lines and a plurality of data lines;

a gate driving circuit including a plurality of stages to output gate signals to the plurality of gate lines; and a data driving circuit to drive the plurality of data lines, wherein a k-th stage from among the plurality of stages (where k is a natural number greater than or equal to 2) includes:

a first input circuit to receive a (k−1)th gate signal from a (k−1)th stage and to precharge a first node;

a second input circuit to receive a (k+2)th gate signal from a (k+2)th stage to transmit the received (k+2)th gate signal to a second node;

an output circuit to output a first clock signal as a k-th gate signal in response to a signal of the first node;

a discharge circuit to discharge the first node through a connection to an output line of the output circuit that outputs the k-th gate signal in response to a signal of the second node;

a first transfer circuit to transfer a second clock signal to the first node; and a second transfer circuit to transfer the first clock signal to the second node.

12. The display device as claimed in claim 11, wherein the output circuit includes an output transistor having a first electrode connected to the first clock signal, a second electrode to output the k-th gate signal, and a gate electrode connected to the first node.

13. The display device as claimed in claim 12, wherein the first transfer circuit includes:

a first transfer transistor having a first electrode connected to the second clock signal, a second electrode connected to the first node, and a gate electrode connected to the second clock signal; and a first transfer capacitor connected between the first node and the second electrode of the first output transistor.

14. The display device as claimed in claim 11, wherein the second transfer circuit includes:

a second transfer capacitor connected between the first clock signal and the second node; and a second transfer transistor having a first node connected to the second node, a second electrode connected to the (k+2)th gate signal from the (k+2)th stage, and a gate electrode connected to the second node.

15. The display device as claimed in claim 11, wherein the first input circuit includes:

a first input transistor having a first electrode connected to the (k−1)th gate signal from the (k−1)th stage, a second electrode connected to the first node, and a gate electrode connected to the (k−1)th gate signal.

16. The display device as claimed in claim 11, wherein the second input circuit includes:

a second input transistor having a first electrode connected to the (k+2)th gate signal from the (k+2)th stage, a second electrode connected to the second node, and a gate electrode connected to the (k+2)th gate signal.

17. The display device as claimed in claim 11, wherein, when the second clock signal shifts from a low level to a high level, the first transfer circuit transfers the second clock signal to the first node at a speed proportional to a first time constant.

18. The display device as claimed in claim 11, wherein the second transfer circuit transfers the first clock signal to the second node and discharges a signal of the second node as a signal level of the second input terminal at a speed proportional to a second time constant.

19. The display device as claimed in claim 11, wherein the display panel includes:

a display area where the plurality of pixels are arranged; and a non display area adjacent to the display area, wherein the gate driving circuit is integrated into the non display area.

20. The display device as claimed in claim 11, further including a driving controller to control the gate driving circuit and the data driving circuit in response to a control signal and an image signal provided from the outside, and provide the first clock signal and the second clock signal to each of the plurality of stages.

* * * * *